US009851675B2

(12) United States Patent
Takiguchi et al.

(10) Patent No.: US 9,851,675 B2
(45) Date of Patent: Dec. 26, 2017

(54) IMAGE FORMING APPARATUS

(71) Applicant: CANON KABUSHIKI KAISHA, Tokyo (JP)

(72) Inventors: Masatoshi Takiguchi, Yokohama (JP); Koji Fujinaka, Chofu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/076,425

(22) Filed: Mar. 21, 2016

(65) Prior Publication Data

US 2016/0282787 A1 Sep. 29, 2016

(30) Foreign Application Priority Data

Mar. 27, 2015 (WO) ..... PCT/JP2015/059595

(51) Int. Cl.
*G03G 15/00* (2006.01)

(52) U.S. Cl.
CPC ..... *G03G 15/6511* (2013.01); *G03G 2215/00396* (2013.01)

(58) Field of Classification Search
CPC ..... G03G 15/6511
USPC ..... 399/388
See application file for complete search history.

(56) References Cited

U.S. PATENT DOCUMENTS 5,201,873 A * 4/1993 Kikuchi ..... B41J 13/0018 271/117
5,358,230 A * 10/1994 Ikemori ..... B65H 1/12 271/114
6,085,051 A * 7/2000 Miyasaka ..... G03G 5/04 399/110
9,588,474 B2 * 3/2017 Tomoe ..... G03G 15/65
2004/0052557 A1 * 3/2004 Fukuta ..... G03G 21/00 399/345
2007/0147919 A1 * 6/2007 Lim ..... B41J 11/006 399/388
2013/0223907 A1 * 8/2013 Suzuki ..... G03G 15/1665 399/388
2013/0270764 A1 * 10/2013 Mizuno ..... B65H 5/06 271/10.11

FOREIGN PATENT DOCUMENTS

JP 4-350033 A 12/1992
JP 6-035254 A 2/1994
JP 2011-018017 A 1/2011
JP 2012-155098 A 8/2012

* cited by examiner

*Primary Examiner* — Anthony Nguyen

(74) *Attorney, Agent, or Firm* — Canon USA, Inc. I.P. Division

(57) ABSTRACT

An object is to provide an image forming apparatus capable of switching, with a simple configuration, the positional relation between a supporting member and a feeding member and the positional relation between a developing member and a photosensitive member. A separation cam 100 rotated by the driving force of a motor M and a slider 101 moving in accordance with the rotation of the separation cam 100 are configured to switch the positional relation between a lifting plate 13 and a feeding roller 3 and the positional relation between a developing roller 103*b* and a photosensitive drum 8.

16 Claims, 9 Drawing Sheets

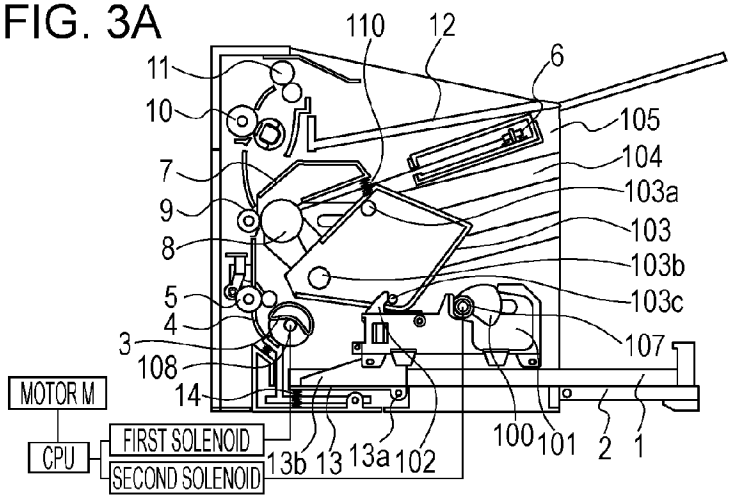
FIG. 3A
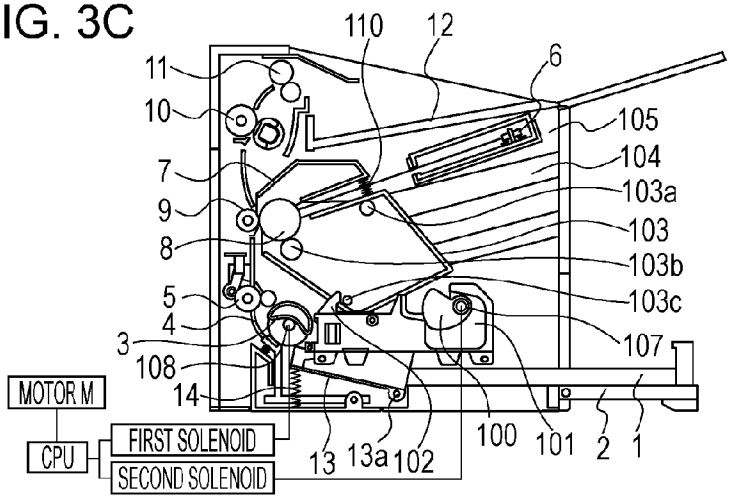
FIG. 3B
FIG. 3C
FIG. 3D

IMAGE FORMING APPARATUS

TECHNICAL FIELD

The present invention relates to an image forming apparatus.

BACKGROUND ART

Conventionally, image forming apparatuses, such as copiers, printers, and facsimiles, include a feeding device for feeding a sheet to an image forming unit. The feeding device includes a supporting member configured to support at least one sheet thereon, and a feeding roller configured to feed the sheet supported by the supporting member.

PTL 1 describes a configuration where a supporting member is moved up and down by a cam mounted on the same shaft as a feeding roller. In the configuration described in PTL 1, the supporting member can be lowered by the cam after completion of a print job. This allows the user to easily place additional sheets.

PTL 2 describes a configuration where a developing roller is brought into contact with a photosensitive drum when image formation is performed, whereas the developing roller is separated from the photosensitive drum when image formation is not performed.

CITATION LIST

Patent Literature

PTL 1 Japanese Patent Laid-Open No. 4-350033
PTL 2 Japanese Patent Laid-Open No. 2011-018017

If a configuration for switching the positional relation between the supporting member and the feeding member and a configuration for switching the positional relation between the developing member and the photosensitive member are independently provided in the image forming apparatus, the resulting configuration of the apparatus is complex and undesirable.

An object of the present invention is to provide an image forming apparatus capable of switching, with a simple configuration, the positional relation between the supporting member and the feeding member and the positional relation between the developing member and the photosensitive member.

SUMMARY OF INVENTION

The present invention provides an image forming apparatus including a supporting member configured to support at least one sheet thereon; a feeding number configured to feed the sheet; a photosensitive member; a developing member configured to develop a latent image formed on the photosensitive member; driving means for generating a driving force; and switching means for switching, by the driving force, a positional relation between the supporting member and the feeding member and a positional relation between the photosensitive member and the developing member, between a first state and a second state where the supporting member and the feeding member are more distant from each other than in the first state and the photosensitive member and the developing member are more distant from each other than in the first state.

Further features of the present invention will become apparent from the following description of exemplary embodiments with reference to the attached drawings.

BRIEF DESCRIPTION OF DRAWINGS

FIGS. 3A to 3D are cross-sectional views illustrating an operation of the image forming apparatus according to the first embodiment.

DESCRIPTION OF EMBODIMENTS

First Embodiment

Figure 1:
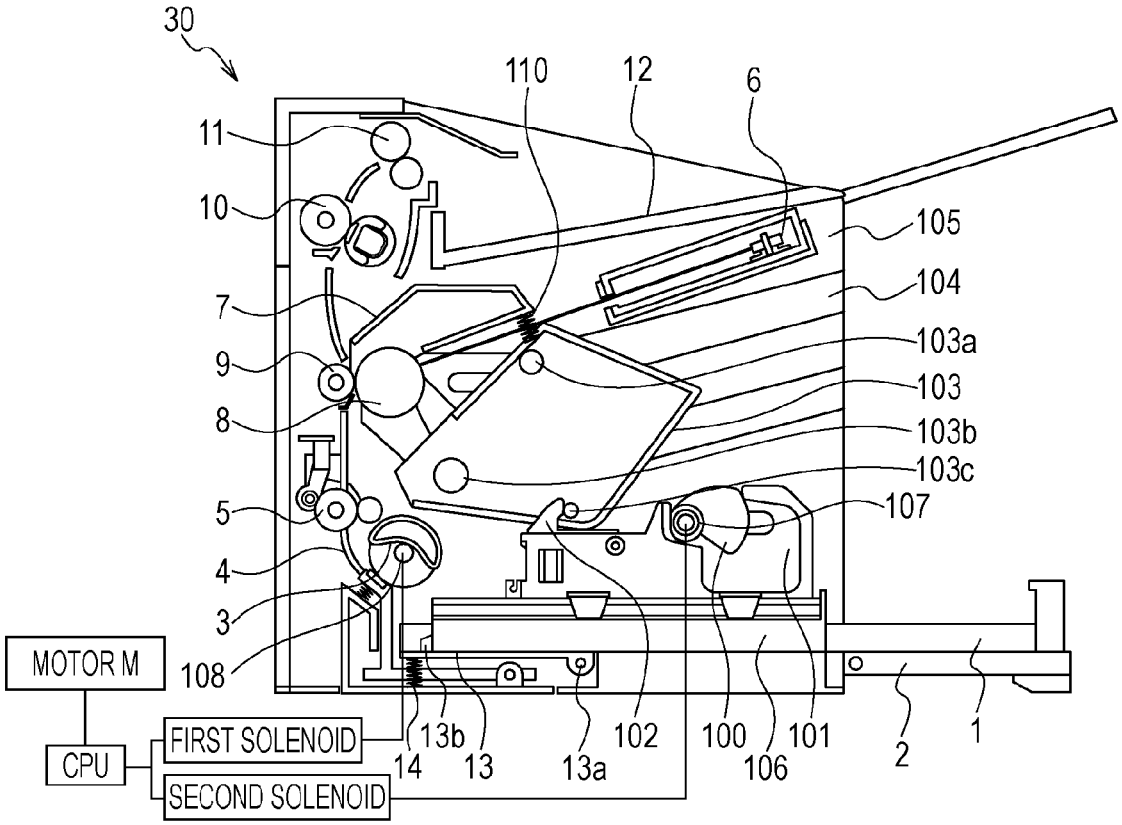
FIG. 1 is a cross-sectional view illustrating a configuration of an image forming apparatus according to a first embodiment.
Figure 2:
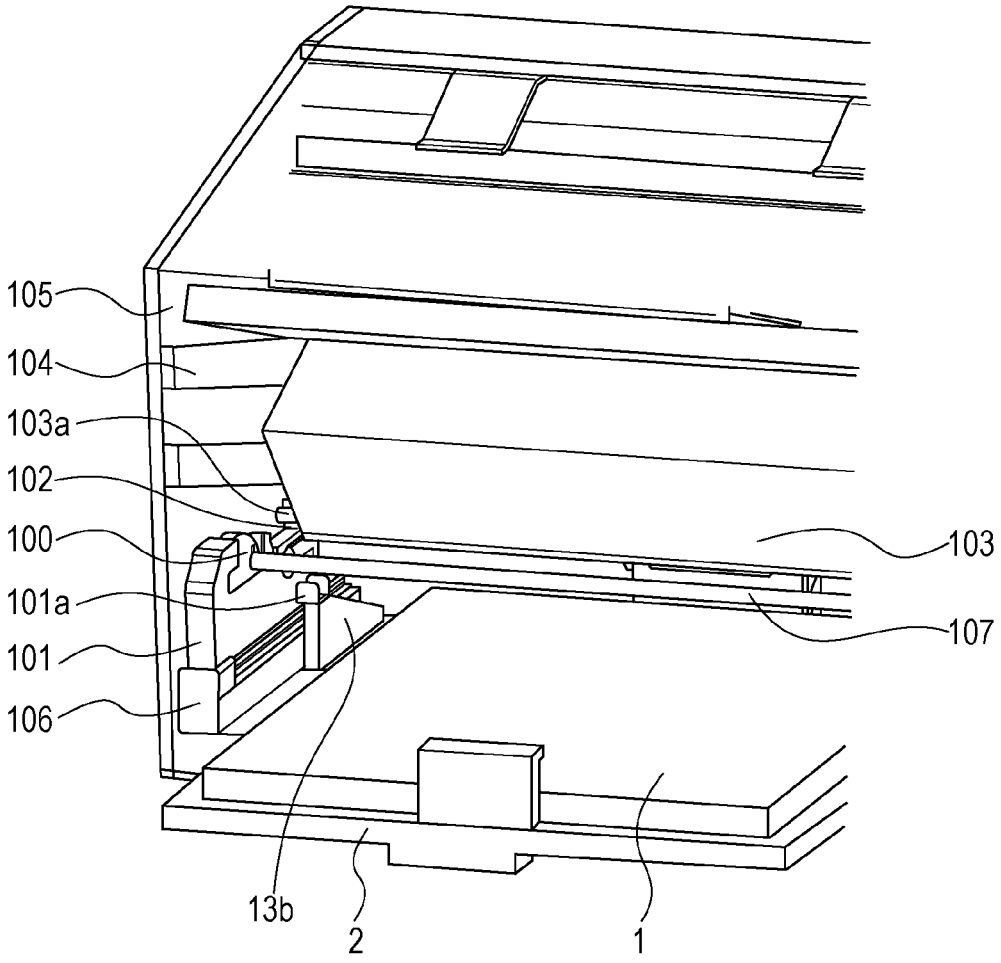
FIG. 2 is a perspective view illustrating a configuration of the image forming apparatus according to the first embodiment.

An image forming apparatus of a first embodiment to which the present invention is applied will now be specifically described. FIG. 1 is a cross-sectional view illustrating a general configuration of an image forming apparatus 30. FIG. 2 is a perspective view of the image forming apparatus 30.

As illustrated in FIG. 1, the image forming apparatus 30 includes a feeding tray 2 that holds a stack of sheets 1. When a print job signal is input from a host computer (not shown) connected to the image forming apparatus 30, a feeding roller (feeding member) 3 in the image forming apparatus 30 rotates to feed the top sheet 1 held in the feeding tray 2. The fed sheet 1 is guided by a conveying guide 4 and conveyed to a registration roller pair 5. In synchronization with image information formed on a photosensitive drum (photosensitive member) 8 in a process cartridge 7, the sheet 1 conveyed by the registration roller pair 5 is further conveyed by a scanner unit 6 to a nip portion (transfer portion) between the photosensitive drum 8 and a transfer roller 9.

A toner image on the photosensitive drum 8 is developed by the process cartridge 7 and a developing cartridge 103. A developing roller (developing member) 103*b* in the developing cartridge 103 rotates while being in contact with the photosensitive drum (photosensitive member) 8, thereby developing a latent image formed on the photosensitive drum 8. A transfer process is performed by a transfer bias applied to the transfer roller 9. The toner image formed on the surface of the photosensitive drum 8 is thus directly transferred to the sheet 1 at the transfer portion. The sheet 1 having the toner image transferred thereto is conveyed to a fixing device 10, where the toner image is fixed onto the sheet 1 by heat and pressure. The sheet 1 having the toner image fixed thereto is discharged by a discharge roller pair 11 to the outside of the image forming apparatus and then onto a discharge tray 12.

As illustrated in FIG. 1, a CPU of the image forming apparatus 30 is connected to a driving means including a motor (driving source) M that generates a driving force, a first clutch including a first solenoid that controls transmission of the driving force of the motor M, and a second clutch including a second solenoid. The first solenoid is disposed in a drive transmission path between the motor M and a feeding shaft 108 (described below), and the second solenoid is disposed in a drive transmission path between the motor M and a separation cam shaft 107 (described below).

The feeding shaft 108 is rotatably disposed in a frame member (apparatus main body) 105 of the image forming apparatus 30. When a driving signal is input from the CPU to the first solenoid, the feeding shaft 108 rotates a full turn in a clockwise (CW) direction in FIG. 1. The feeding roller 3 is securely supported on the axis of the feeding shaft 108. The feeding roller 3 feeds the top sheet 1 on a lifting plate (supporting member) 13 by rotating while being in contact with the top sheet 1.

The lifting plate 13 that supports the sheet 1 is disposed in the frame member 105 to be pivotable about a pivot center 13*a*. As illustrated in FIG. 2, the lifting plate 13 has a lifting plate rib (first engaged portion) 13*b*. In the first embodiment, the lifting plate rib 13*b* is molded as an integral part of the lifting plate 13. The lifting plate rib 13*b* can be engaged with a slider boss (first engaging portion) 101*a* (described below). By a lifting plate spring 14 serving as a first elastic member, the lifting plate 13 is elastically biased toward the feeding roller 3 (upward in FIG. 1) such that the sheet 1 supported by the lifting plate 13 comes into contact with the feeding roller 3. The lifting plate spring 14 used here is a compression spring.

The developing cartridge 103 is disposed to be pivotable about a pivot center 103*a* with respect to the process cartridge 7. A cartridge spring 110 serving as a second elastic member is disposed between the process cartridge 7 and the developing cartridge 103. The cartridge spring 110 biases the developing roller 103*b* toward the photosensitive drum 8. The cartridge spring 110 is a compression spring. By the cartridge spring 110, the developing cartridge 103 is elastically biased about the pivot center 103*a* in the CW direction.

The developing cartridge 103 has an engagement boss (second engaged portion) 103*c*. In the first embodiment, the engagement boss 103*c* is molded as an integral part of the developing cartridge 103. The engagement boss 103*c* is provided such that it can be engaged with an engagement claw (second engaging portion) 102 (described below).

A cartridge guide 104 is securely supported by the frame member 105. The process cartridge 7 is provided such that it can be attached to and detached from the image forming apparatus 30 through the cartridge guide 104. The cartridge guide 104 is configured to guide the attachment and detachment of the process cartridge 7.

The first embodiment includes a rotatable separation cam (first moving member) 100 for switching the positional relation between the lifting plate 13 and the feeding roller 3 and the positional relation between the photosensitive drum 8 and the developing roller 103*b*. The separation cam 100 can take a first cam position (first rotational position) illustrated in FIG. 3A (described below), and a second cam position (second rotational position) illustrated in FIG. 3C (described below).

The separation cam 100 is securely supported on the axis of a separation cam shaft 107. The separation cam shaft 107 is disposed to be rotatable with respect to the frame member 105. When a driving signal is input from the CPU to the second solenoid, the separation cam shaft 107 rotates a half turn in the CW direction in FIG. 1.

The first embodiment includes a slider (second moving member) 101 that moves in accordance with the rotation of the separation cam 100. The slider 101 is disposed to be movable between a first travel position illustrated in FIG. 3A (described below) and a second travel position illustrated in FIG. 3C (described below). The slider 101 can slide in the right and left (horizontal) direction in FIG. 1 by being guided by a slider guide 106. The slider guide 106 is securely supported by the frame member 105. As illustrated in FIG. 2, the slider 101 has the engagement claw 102 and the slider boss 101*a*. In the first embodiment, the slider boss 101*a* is molded as an integral part of the slider 101.

As illustrated in FIG. 2, the slider boss 101*a* is provided such that it can engage with the lifting plate rib 13*b*. The slider boss 101*a* is provided to be movable between a position at which it presses the lifting plate rib 13*b* against the biasing force of the lifting plate spring 14 and a position at which it releases the pressure applied to the lifting plate rib 13*b*. Accordingly, when the slider 101 reciprocates once, the lifting plate 13 pivots once about the pivot center 13*a*.

Also as illustrated in FIG. 2, the engagement claw 102 is provided such that it can engage with the engagement boss (second engaged portion) 103*c* of the developing cartridge 103. The engagement claw 102 is provided to be movable between a position at which it presses the engagement boss 103*c* against the biasing force of the cartridge spring 110 and a position at which it releases the pressure applied to the engagement boss 103*c*. Accordingly, when the slider 101 reciprocates once, the developing cartridge 103 pivots once about the pivot center 103*a*.

In the configuration described above, when a driving signal is input from the CPU to the second solenoid, the separation cam shaft 107 and the separation cam 100 rotate together a half turn in the CW direction. Accordingly, the slider 101 slides and the lifting plate 13 and the developing cartridge 103 operate in conjunction with each other.

The operation of the image forming apparatus 30 according to the first embodiment will now be described with reference to FIG. 3. FIG. 3 is a cross-sectional view illustrating an operation of the image forming apparatus 30 according to the first embodiment. Note that the slider guide 106 is omitted in FIG. 3 for the purpose of clearly illustrating the operation of the lifting plate 13.

FIG. 3A illustrates a print standby state of the image forming apparatus 30. In the state illustrated in FIG. 3A, the separation cam 100 is located at the first cam position, and the slider 101 is located at the first travel position. In this state, the lifting plate rib 13*b* of the lifting plate 13 biased by the lifting plate spring 14 is at rest while being in contact with the slider boss 101*a* of the slider 101. At the same time, the engagement boss 103*c* of the developing cartridge 103 biased by the cartridge spring 110 is at rest while being in contact with the engagement claw 102 on the slider 101. Also, the slider 101 is at rest while being in contact with the separation cam 100. Accordingly, in the state illustrated in FIG. 3A, the developing roller 103*b* and the photosensitive drum 8 are in a separated state, and the top sheet 1 on the lifting plate 13 and the feeding roller 3 are also in a separated state.

When a print job signal is first input from the host computer (not shown) connected to the image forming apparatus 30, input of a driving signal from the CPU to the second solenoid causes the driving force of the motor M to be transmitted to the separation cam 100. Thus, the separation cam 100 starts to rotate in the CW direction, and the slider 101 horizontally moves leftward in FIG. 3. When the slider 101 moves leftward, the engagement claw 102 on the slider 101 also moves leftward, so that the developing cartridge 103 pivots about the pivot center 103*a* in the CW direction. When the slider 101 moves leftward, the slider boss 101*a* of the slider 101 also moves leftward, so that the lifting plate 13 pivots about the pivot center 13*a* in the CW direction. FIG. 3B illustrates a state of the image forming apparatus 30 during rotation of the separation cam 100. In the states illustrated in FIGS. 3A and 3B, the slider 101 is subjected to the biasing force of the cartridge spring 110 in the leftward direction in the drawings. Thus, by the biasing force, the slider 101 is moved from the position shown in FIG. 3A to the position shown in FIG. 3B.

The separation cam 100 stops rotating in the state of FIG. 3C reached by rotating backward from the state of FIG. 3A. This causes the slider 101 to stop its leftward horizontal movement. In the state of FIG. 3C, the separation cam 100 is located at the second cam position, and the slider 101 is located at the second travel position. In the state of FIG. 3C, the pressure applied to the engagement boss 103*c* by the engagement claw 102 is released, and the pressure applied to the lifting plate rib 13*b* by the slider boss 101*a* is released. This allows the developing roller 103*b* biased by the cartridge spring 110 to come into contact with the photosensitive drum 8, and allows the top sheet 1 on the lifting plate 13 biased by the lifting plate spring 14 to come into contact with the feeding roller 3. That is, the developing roller 103*b* and the photosensitive drum 8 are in a contact state, and the top sheet 1 on the lifting plate 13 and the feeding roller 3 are in a contact state.

When the CPU inputs a driving signal to the first solenoid in the state of FIG. 3C, the driving force of the motor M is transmitted to the feeding roller 3. This causes the feeding roller 3 to rotate in the CW direction, thereby starting the operation of feeding the sheet 1. As described above, an image is formed on the fed sheet 1 by being transferred and fixed. Then, the sheet 1 having the image formed thereon is discharged to the discharge tray 12. In the first embodiment, it is possible to feed as many sheets 1 as needed without moving up and down the lifting plate 13 from the state illustrated in FIG. 3C.

When the CPU inputs a driving signal to the second solenoid after the completion of the operation of feeding the sheet 1, the separation cam 100 starts to rotate in the CW direction. Since the separation cam 100 rotates while pressing the slider 101 rightward in FIG. 3, the slider 101 moves rightward in FIG. 3. Together with the slider 101, the engagement claw 102 and the slider boss 101*a* of the slider 101 move rightward in FIG. 3. Then, when the engagement claw 102 presses the engagement boss 103*c* against the elastic force of the cartridge spring 110, the developing cartridge 103 pivots about the pivot center 103*a* in a counterclockwise (CCW) direction. Also, when the slider boss 101*a* presses the lifting plate rib 13*b* against the elastic force of the lifting plate spring 14, the lifting plate 13 pivots about the pivot center 13*a* in the CCW direction. FIG. 3D illustrates a state of the image forming apparatus 30 during rotation of the separation cam 100.

The separation cam 100 rotates backward in the CW direction from the state of FIG. 3C to return to the state of FIG. 3A, where it stops rotating. This causes the slider 101 to stop its rightward horizontal movement, and thus causes the print job to end. Every time a print job signal is input, the image forming apparatus 30 of the first embodiment performs the above-described operation to form an image on the sheet 1.

As described above, the first embodiment includes the separation cam (first moving member) 100 and the slider (second moving member) 101 as switching means for switching the positional relation between the lifting plate 13 and the feeding roller 3 and the positional relation between the developing roller 103*b* and the photosensitive drum 8. The separation cam 100 and the slider 101 are operated by the motor M serving as a common driving source. Thus, with a simple configuration, the image forming apparatus of the first embodiment can switch the positional relation between the lifting plate 13 and the feeding roller 3 and the positional relation between the developing roller 103*b* and the photosensitive drum 8.

Figure 4:
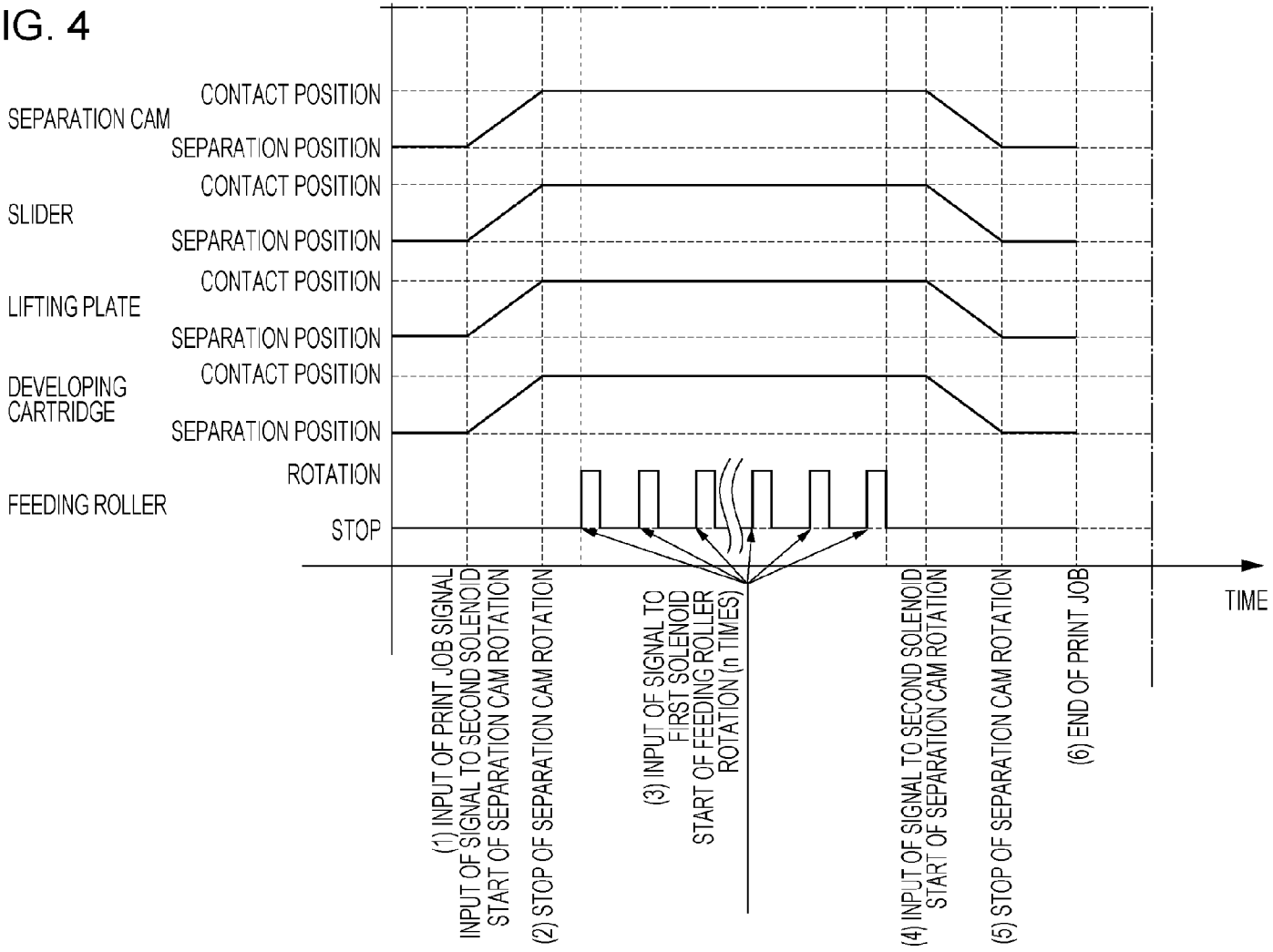
FIG. 4 is a diagram showing a sequence in the image forming apparatus according to the first embodiment.

FIG. 4 is a diagram showing a sequence in the image forming apparatus 30 described above. This sequence diagram shows a sequence carried out when a continuous print job signal for n sheets is input to the image forming apparatus 30. In FIG. 4, the vertical axis shows mechanical components, and the horizontal axis represents time.

The states and positions of the mechanical components shown in FIG. 4 will now be defined. The feeding roller 3 can take two states, a rotating (rotation) state and a non-rotating (stop) state. The developing cartridge 103, the lifting plate 13, the slider 101, and the separation cam 100 each can take two stop positions, a separation position and a contact position, and operate between these positions. Note that the separation position is the position of each component in the state of FIG. 3A, and the contact position is the position of each component in the state of FIG. 3C.

The description of a sequence of operations from the input of a print job signal to the end of the print job, shown in (1) to (6) of FIG. 4, will be omitted here, as it is the same as the description of the operations described above. A point to be clearly described with reference to FIG. 4 is that, for a continuous print job signal for n sheets, the lifting plate is moved up and down only once.

Figure 9:
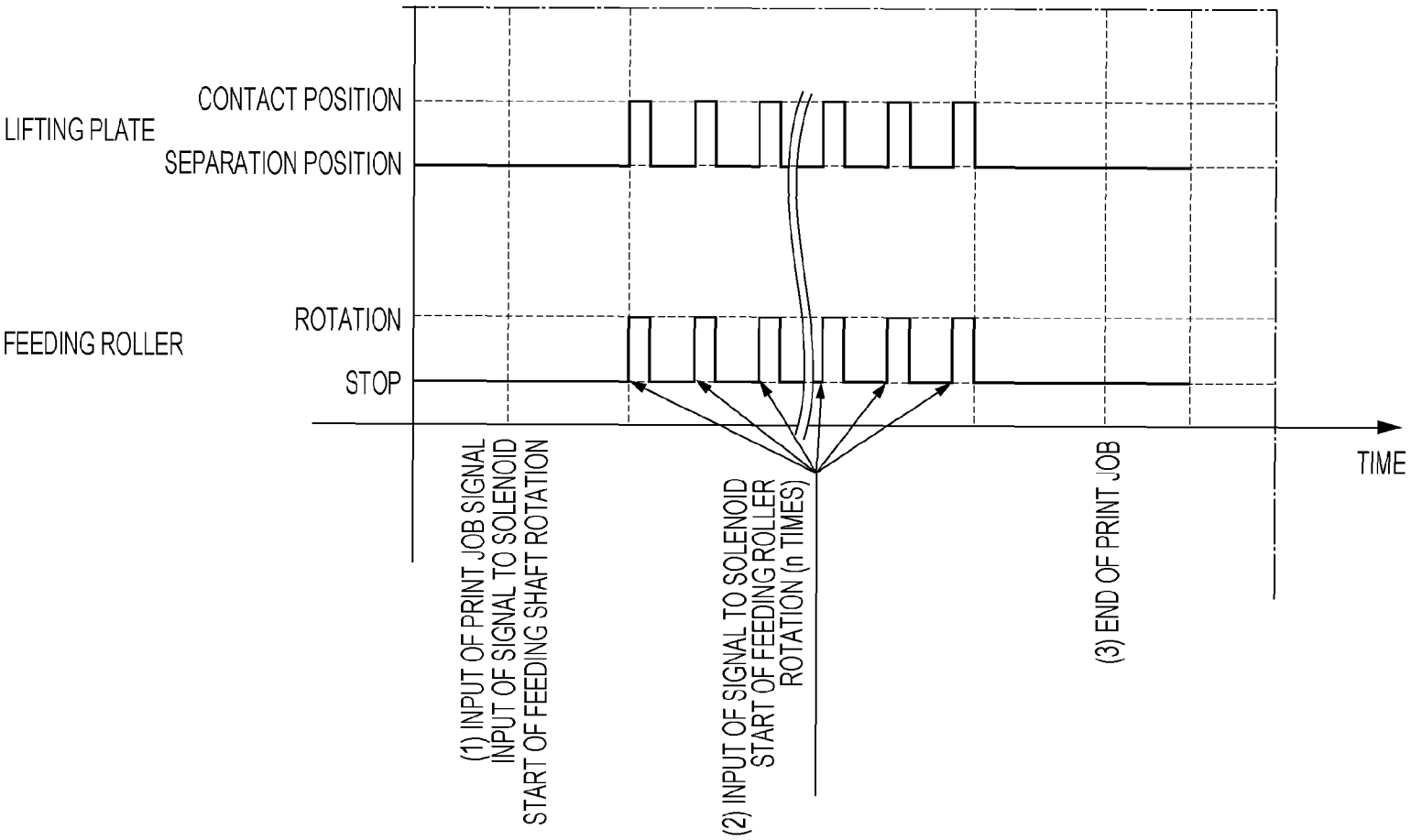
(RELATED ART) FIG. 9
FIG. 9 is a sequence diagram of the conventional image forming apparatus.

In a conventional example shown in FIG. 9, the lifting plate is moved up and down n times for a continuous print job signal for n sheets. On the other hand, in the configuration of the first embodiment, as shown in FIG. 4, the number of times the lifting plate is moved up and down can be reduced to once for each print job. It is thus possible to reduce noise associated with the up and down movement of the lifting plate during continuous printing, and to provide a quieter image forming apparatus.

In the first embodiment, after the completion of the print job, the components can be returned at any time to the positions in the print standby state shown in FIG. 3A. The lifting plate 13 is located at a lower position in the state shown in FIG. 3A. This allows the user to place additional sheets 1 and carry out a replacement operation, thereby making it possible to maintain high usability. Also, in the state shown in FIG. 3A, the developing roller 103*b* is at rest at a distance from the photosensitive drum 8. This can prevent deformation of the developing roller 103*b* and the photosensitive drum 8.

Second Embodiment

A second embodiment will now be described. In the following description of the second embodiment, the same components and operations as those of the first embodiment may not be described. The second embodiment differs from the first embodiment in the location of the cartridge spring for generating a contact pressure between the photosensitive drum 8 and the developing roller 103*b*.

Figure 5:
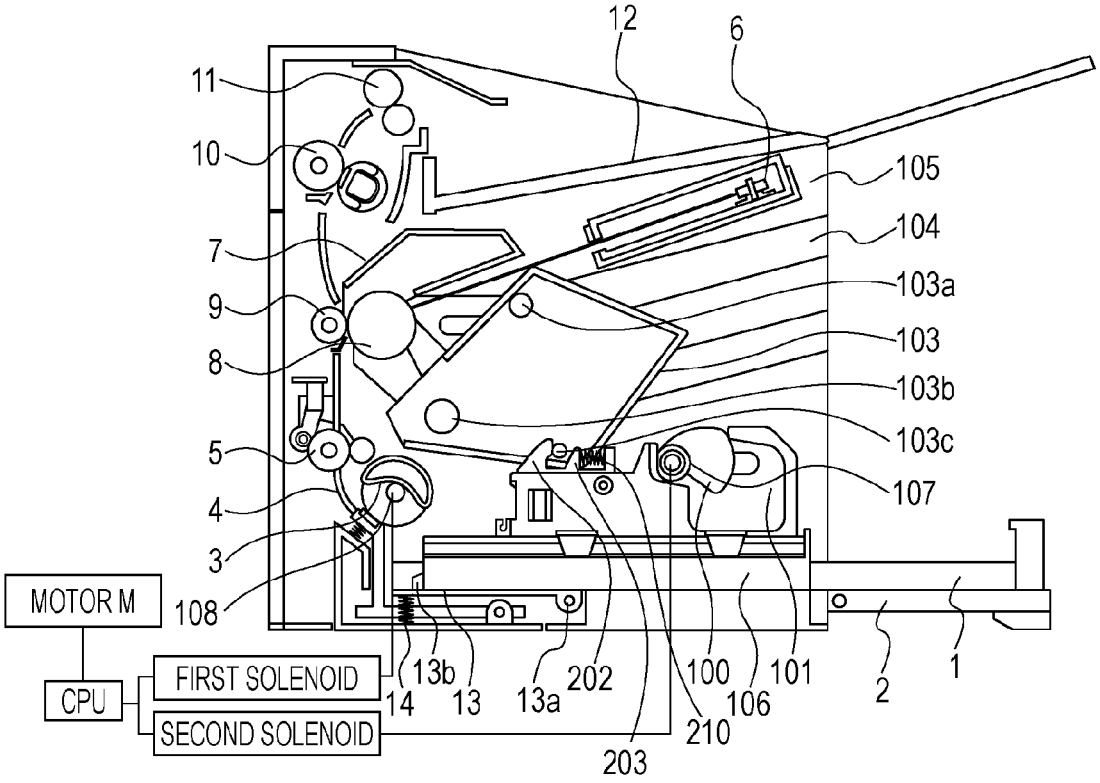
FIG. 5 is a cross-sectional view illustrating a configuration of an image forming apparatus according to a second embodiment.

FIG. 5 is a cross-sectional view illustrating an image forming apparatus according to the second embodiment. As in the first embodiment, an engagement claw 202 is provided on the slider 101. The slider 101 is provided with a cartridge pressing member 203. The cartridge pressing member 203 is biased by a cartridge spring 210 in the leftward direction in FIG. 5, and is provided to be movable with respect to the slider 101 in the right and left direction. The cartridge spring 210 is a compression spring, and the other end of the cartridge spring 210 engages with a component on the apparatus main body side.

The operation of the image forming apparatus according to the second embodiment will now be described. FIG. 6 is a cross-sectional view illustrating an operation of the image forming apparatus according to the second embodiment. Note that the slider guide 106 is omitted in FIG. 6 for the purpose of clearly illustrating the operation of the lifting plate 13.

An overall operation of the second embodiment will not be described here, as it is the same as the first embodiment. The second embodiment differs from the first embodiment in the operation process where the lifting plate spring 14 and the cartridge spring 210 are compressed.

Figure 6C:
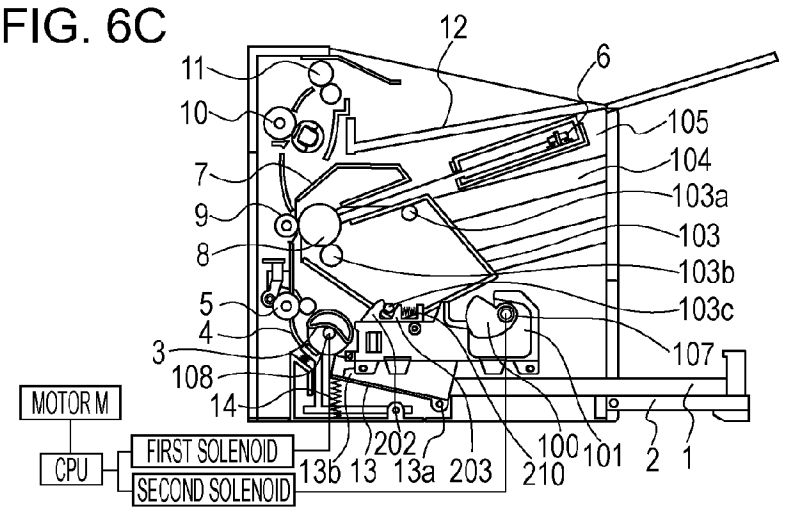
FIGS. 6A to 6D are cross-sectional views illustrating an operation of the image forming apparatus according to the second embodiment.
Figure 6A:
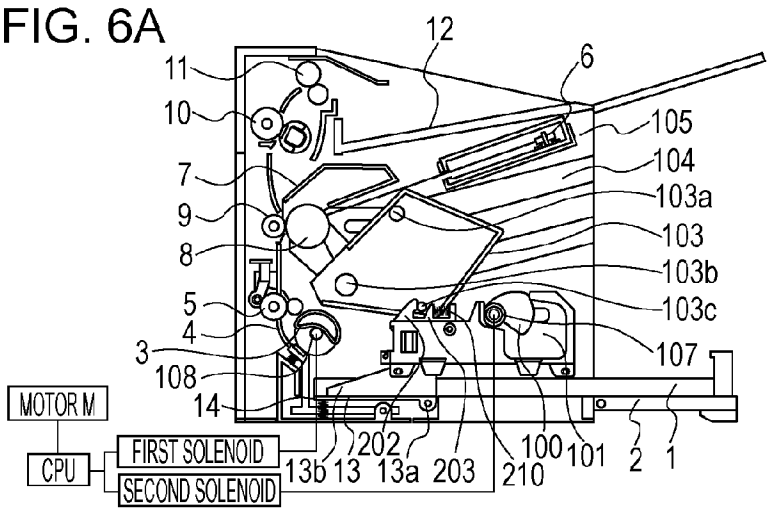
Figure 6D:
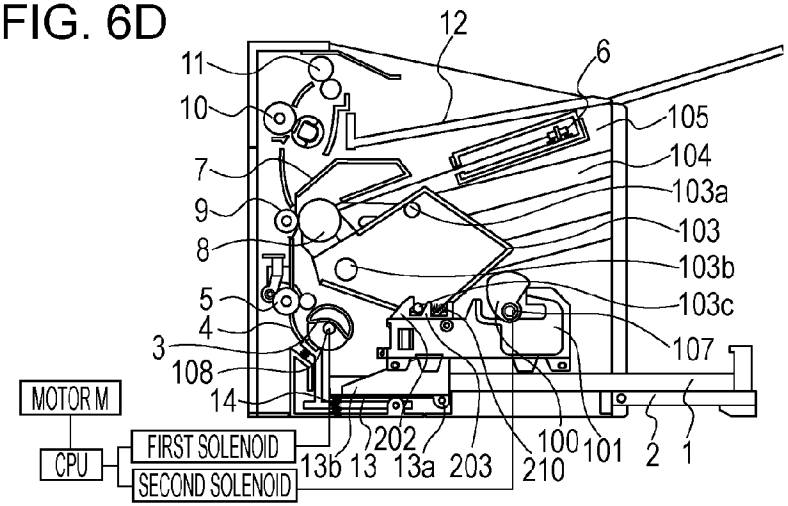

In the state illustrated in FIG. 6A, the developing cartridge 103 is at rest, with the engagement boss 103*c* being in contact with the engagement claw 202 on the slider 101. Since the cartridge pressing member 203 is not in contact with the engagement boss 103*c*, the cartridge spring 210 is in a released state at this point. The lifting plate spring 14 is in a compressed state.

In the state illustrated in FIG. 6C, the developing cartridge 103 is at rest, with the engagement boss 103*c* being pressed by the cartridge pressing member 203. At this point, the cartridge pressing member 203 presses the engagement boss 103*c* and the cartridge spring 210 is in a compressed state. The lifting plate spring 14 is in a released state.

The first embodiment is configured such that, in the operation process from FIG. 3C to FIG. 3A, the lifting plate spring 14 and the cartridge spring 110 are simultaneously brought into a compressed state (where the elastic force is being charged). Therefore, the first embodiment requires a driving torque for compressing the two elastic members, the lifting plate spring 14 and the cartridge spring 110, against their elastic force, and hence requires a driving source and a power source that can provide the driving torque.

Figure 6B:
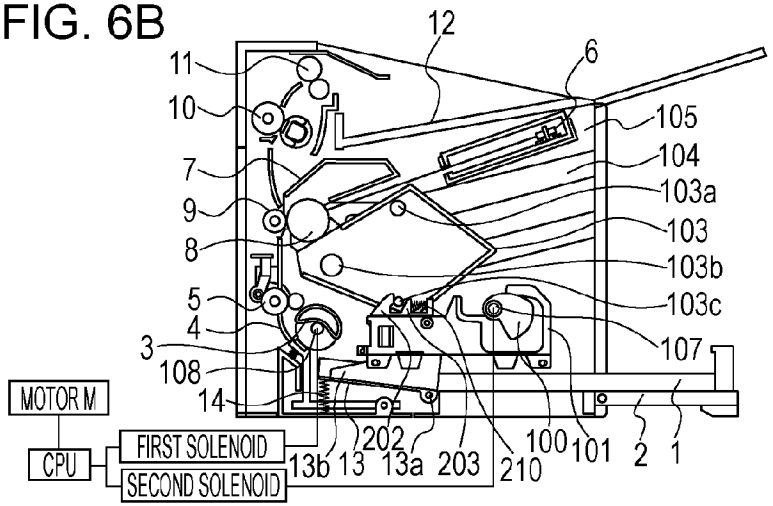

In the second embodiment, on the other hand, in the operation process from FIG. 6A to FIG. 6C, the cartridge spring 210 is brought into a compressed state, whereas the lifting plate spring 14 is brought into a released state. In the operation process from FIG. 6C to FIG. 6A, the lifting plate spring 14 is brought into a compressed state, whereas the cartridge spring 210 is brought into a released state. Therefore, the driving torque can be reduced in the second embodiment, as there is no need to provide the driving torque for compressing two springs in a single operation process.

Figure 7:
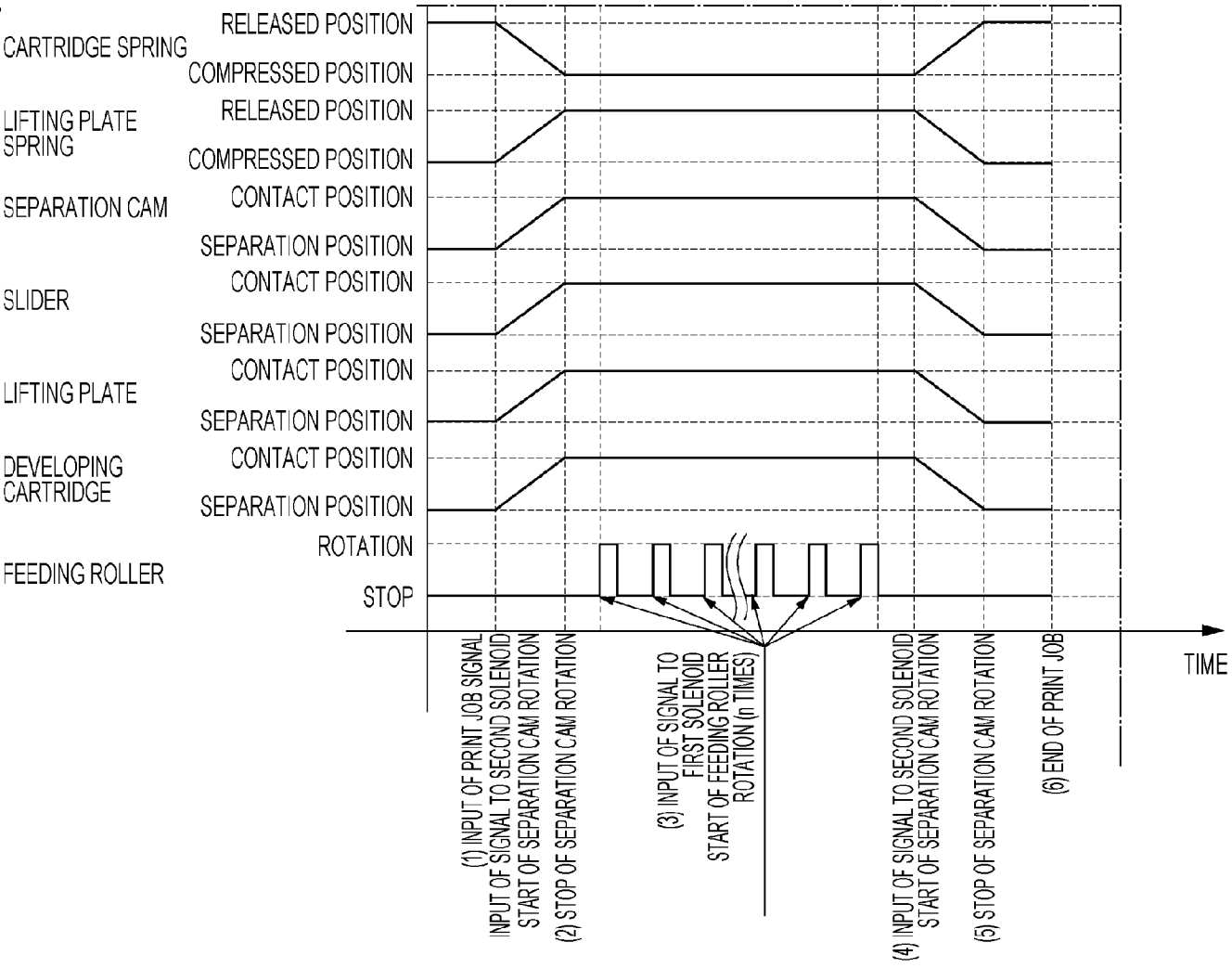
FIG. 7 is a diagram showing a sequence in the image forming apparatus according to the second embodiment.

FIG. 7 is a diagram showing a sequence in the second embodiment. This sequence diagram shows a sequence carried out when a continuous print job signal for n sheets is input to the image forming apparatus. In FIG. 7, the vertical axis shows mechanical components, and the horizontal axis represents time.

A point to be clearly described with reference to FIG. 7 is that, in the second embodiment, the timing of compression of the lifting plate spring 14 differs from the timing of compression of the cartridge spring 210. Thus, by separating the operation process which involves compression of the lifting plate spring 14 from the operation process which involves compression of the cartridge spring 210, a reduction in driving torque can be achieved, as well as the advantageous effect of the first embodiment. The other description will be omitted, as it is the same as the description for FIG. 4 in the first embodiment.

Accordingly, in the second embodiment, it is possible to use an inexpensive driving source and power source, and thus to provide an inexpensive image forming apparatus.

In the first and second embodiments described above, the switching means is configured to bring the developing roller 103*b* into contact with, and to separate it from, the photosensitive drum 8. However, the present invention is not to be limited to this. That is, the present invention may be configured such that the positional relation between the developing roller 103*b* and the photosensitive drum 8 is switched between a first state where they are close in distance to each other and a second state where they are more distant from each other than in the first state. Even in this configuration, deformation of the developing roller 103*b* and the photosensitive drum 8 can be prevented by switching the positional relation between the developing roller 103*b* and the photosensitive drum 8 to the second state when no image formation is performed or during product distribution. Note that the first state described above does not necessarily refer to a state where the developing roller 103*b* and the photosensitive drum 8 are in contact, and the second state does not necessarily refer to a state where the developing roller 103*b* and the photosensitive drum 8 are separated from each other.

Similarly, the present invention is not to be limited to the configuration where the top sheet 1 on the lifting plate and the feeding roller 3 are brought into contact with, and separated from, each other. That is, the present invention may be configured such that the positional relation between the lifting plate 13 and the feeding roller 3 is switched between a state (first state) where they are close in distance to each other and a state (second state) where they are more distant from each other than in the first state.

Figure 8:
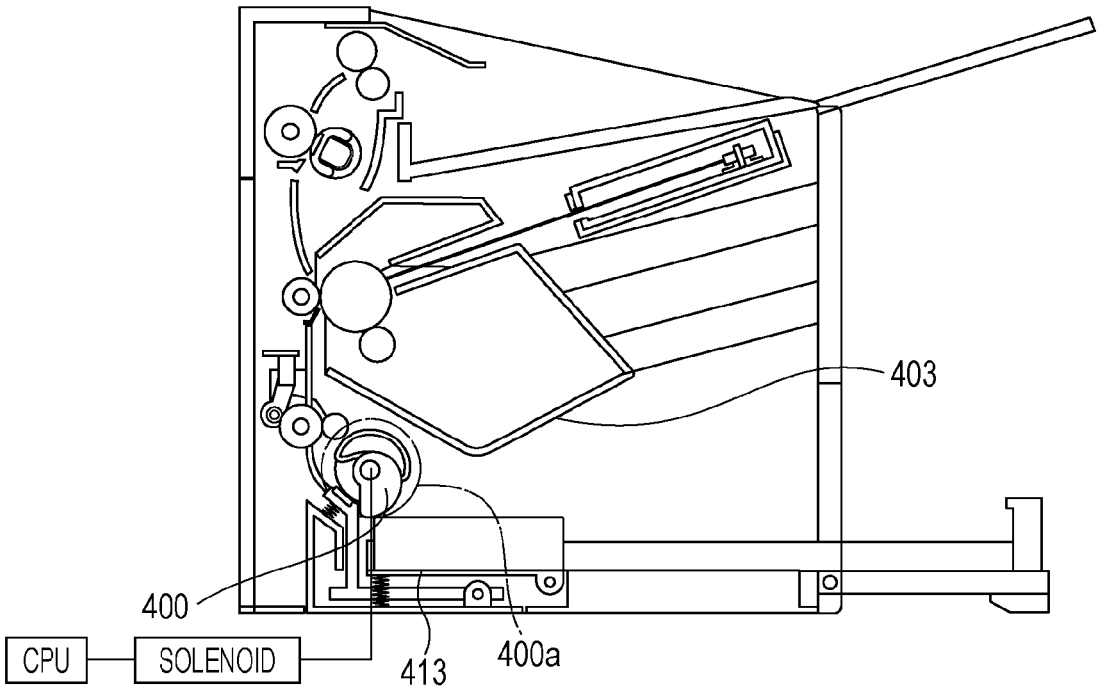
FIG. 8 (RELATED ART)
FIG. 8 is a cross-sectional view illustrating a configuration of a conventional image forming apparatus.

Since the first and second embodiments are configured to move the lifting plate 13 up and down using the slider 101 that horizontally moves, it is possible to increase the amount of sheets 1 that can be supported. In the configuration of a conventional example illustrated in FIG. 8, to support a larger amount of sheets 1, the outermost diameter of a feeding cam 400 needs to be increased to increase the pivot angle of a lifting plate 413. However, increasing the outermost diameter of the feeding cam 400 may cause interference of a developing cartridge 403 with a rotation path 400*a* (indicated by a broken line) of the feeding cam 400. To avoid the interference, it is necessary to increase the size of the image forming apparatus in the height or width direction.

On the other hand, the first and second embodiments do not require the feeding cam 400, as the slider 101 has the function of causing the lifting plate 13 to pivot. That is, it is possible to provide an image forming apparatus that can support a larger amount of sheets 1, without increasing the size of the main body.

According to the present invention, the switching means switches, by the driving force, the positional relation between the supporting member and the feeding member and the positional relation between the developing member and the photosensitive member. It is thus possible to provide an image forming apparatus that can switch, with a simple configuration, the positional relation between the supporting member and the feeding member and the positional relation between the photosensitive member and the developing member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Patent Application No. PCT/JP2015/059595, filed Mar. 27, 2015, which is hereby incorporated by reference herein in its entirety.

The invention claimed is:

1. An image forming apparatus comprising:

a supporting member configured to support at least one sheet thereon;

a feeding member configured to feed the sheet;

a photosensitive member;

a developing member configured to develop a latent image formed on the photosensitive member;

driving means for generating a driving force; and switching means for switching, by the driving force, a positional relation between the supporting member and the feeding member and a positional relation between the photosensitive member and the developing member, between a first state and a second state where the supporting member and the feeding member are more distant from each other than in the first state and the photosensitive member and the developing member are more distant from each other than in the first state, wherein the switching means switches the positional relation between the photosensitive member and the developing member by moving the developing member.

2. The image forming apparatus according to claim 1, wherein the feeding member feeds the sheet by rotating while being in contact with the sheet supported by the supporting member;

the developing member develops the latent image on the photosensitive member by rotating while being in contact with the photosensitive member; and the first state is a contact state where a top sheet supported by the supporting member is in contact with the feeding member and the photosensitive member and the developing member are in contact with each other, and the second state is a separation state where the top sheet supported by the supporting member is separated from the feeding member and the photosensitive member and the developing member are separated from each other.

3. The image forming apparatus according to claim 2, wherein the switching means includes a first moving member that can be moved by the driving force and can take a first position and a second position; and the switching means switches the positional relation between the supporting member and the feeding member and the positional relation between the photosensitive member and the developing member from the second state to the first state by moving the first moving member from the first position to the second position, and switches the positional relation between the supporting member and the feeding member and the positional relation between the photosensitive member and the developing member from the first state to the second state by moving the first moving member from the second position to the first position.

4. The image forming apparatus according to claim 3, wherein the first moving member is movable by the driving force and can take a first rotational position and a second rotational position; and the switching means switches the positional relation between the supporting member and the feeding member and the positional relation between the photosensitive member and the developing member from the second state to the first state by rotating the first moving member from the first rotational position to the second rotational position, and switches the positional relation between the supporting member and the feeding member and the positional relation between the photosensitive member and the developing member from the first state to the second state by rotating the first moving member from the second rotational position to the first rotational position.

5. The image forming apparatus according to claim 4, wherein the switching means includes a second moving member moved from a first travel position to a second travel position by rotation of the first moving member from the first rotational position to the second rotational position.

6. The image forming apparatus according to claim 5, wherein the second moving member moves in a horizontal direction.

7. The image forming apparatus according to claim 5, wherein the second moving member has a first engaging portion for switching the positional relation between the photosensitive member and the developing member, and a second engaging portion for switching the positional relation between the supporting member and the feeding member.

8. The image forming apparatus according to claim 1, wherein the switching means switches the positional relation between the supporting member and the feeding member by moving the supporting member up and down.

9. The image forming apparatus according to claim 1, further comprising:

a first elastic member configured to generate an elastic force for bringing the sheet supported by the supporting member into contact with the feeding member; and a second elastic member configured to generate an elastic force for bringing the developing member into contact with the photosensitive member.

10. The image forming apparatus according to claim 9, wherein the switching means switches the positional relation between the supporting member and the feeding member and the positional relation between the photosensitive member and the developing member from the first state to the second state, against the elastic force of the first elastic member and the elastic force of the second elastic member.

11. The image forming apparatus according to claim 9, wherein the switching means switches the positional relation between the supporting member and the feeding member and the positional relation between the photosensitive member and the developing member from the first state to the second state against the elastic force of the first elastic member, and switches the positional relation between the supporting member and the feeding member and the positional relation between the photosensitive member and the developing member from the second state to the first state against the elastic force of the second elastic member.

12. The image forming apparatus according to claim 1, wherein the driving means includes a driving source configured to generate the driving force, a first clutch disposed in a drive transmission path between the driving source and the switching means, and a second clutch disposed in a drive transmission path between the driving source and the feeding member.

13. The image forming apparatus according to claim 3, wherein the supporting member is disposed to be pivotable about a pivot; and the first moving member is disposed upstream of the pivot of the supporting member in a direction in which the sheet is fed.

14. The image forming apparatus according to claim 7, wherein a unit including the developing member is attachable to and detachable from the image forming apparatus; and a portion of the unit engaging with the second engaging portion is disposed downstream of the second engaging portion in a direction in which the unit is attached to the image forming apparatus.

15. The image forming apparatus according to claim 1, wherein the image forming apparatus is configured to directly transfer a toner image formed on a surface of the photosensitive member to the sheet fed by the feeding member.

16. An image forming apparatus comprising:

a supporting member configured to support at least one sheet thereon;

a feeding member configured to feed the sheet;

driving means for generating a driving force; and switching means for switching, by the driving force, a positional relation between the supporting member and the feeding member and a positional relation between a photosensitive member and a developing member configured to develop a latent image formed on the photosensitive member, between a first state and a second state where the supporting member and the feeding member are more distant from each other than in the first state and the photosensitive member and the developing member are more distant from each other than in the first state, wherein the switching means switches the positional relation between the photosensitive member and the developing member by moving the developing member.

* * * * *